United States Patent [19]

Domdey

[11] 4,394,815

[45] Jul. 26, 1983

[54] PROCESS FOR GENERATING ELECTRIC POWER BY MEANS OF TURBOGENERATORS USING HIGH PRESSURE VAPOR

[76] Inventor: Otto F. Domdey, Buchenstrasse 58, D-67 Ludwigshafen, Fed. Rep. of Germany

[21] Appl. No.: 224,571

[22] PCT Filed: Mar. 3, 1980

[86] PCT No.: PCT/EP80/00012

§ 371 Date: Nov. 6, 1980

§ 102(e) Date: Nov. 6, 1980

[87] PCT Pub. No.: WO80/01932

PCT Pub. Date: Sep. 18, 1980

[30] Foreign Application Priority Data

Mar. 8, 1979 [CH] Switzerland ..... 2223/79

[51] Int. Cl.[3] ..... F01K 25/06

[52] U.S. Cl. ..... 60/649; 60/327

[58] Field of Search ..... 60/325, 326, 327, 486, 60/649, 673, 398, 698; 290/52

[56] References Cited

U.S. PATENT DOCUMENTS

| | | | |
|---|---|---|---|
| 891,214 | 6/1908 | Graf | 60/325 X |
| 1,060,125 | 4/1913 | Rector | 60/326 |
| 2,151,949 | 3/1939 | Turner | 60/649 |

FOREIGN PATENT DOCUMENTS

| | | | |
|---|---|---|---|
| 212655 | 6/1907 | Fed. Rep. of Germany . | |
| 411559 | 6/1910 | France | 60/325 |

*Primary Examiner*—Allen M. Ostrager
*Assistant Examiner*—Stephen F. Husar

[57] ABSTRACT

A hydraulic turbo-generator driven by a water current is used for producing electric power; the water is driven by a high output rotary pump (3) and supplied to the turbine (5) by means of a cylindrical conduit (4). The high pressure vapor is produced in a vapor generator (2) and injected in the water current, so that the expansion energy of the vapor is transmitted to the water, if possible completely, and to the turbine. The interaction duration of the vapor and the water is considered to be a very short due to the high speed of the water, so that substantially no heat exchange occurs, thereby obtaining a plant output higher than that of conventional plants.

5 Claims, 1 Drawing Figure

Figure 1:
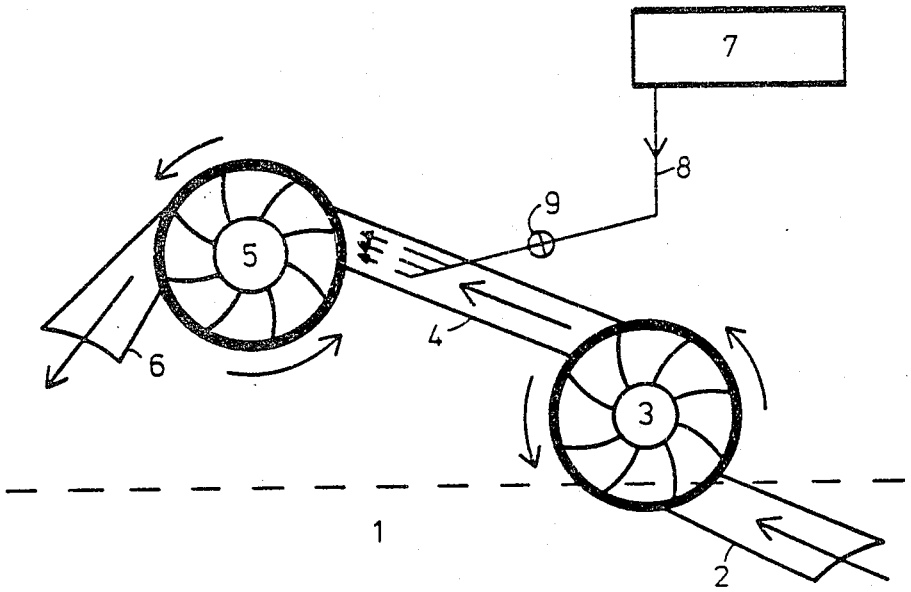

PROCESS FOR GENERATING ELECTRIC POWER BY MEANS OF TURBOGENERATORS USING HIGH PRESSURE VAPOR

Electric generator plants, in which turbogenerators are driven by high pressure vapour, are noted to possess a low efficiency factor only, that is not exceeding the scale of 0.34 c.a.

Basic to this invention is the task, to show a process to generate electric current by means of turbogenerators using high pressure vapour, that enables to obtain a higher efficiency factor.

The solution for this problem is inventively, that a stream of water is being led to the turbines and high pressure vapour is being injected in like direction into the water stream, whereby the reaction-time as regards vapour and water is being held that short, that practically no heat-exchange takes place.

Contrary therefore to the utilizing of steamturbine power plants the vapour acc. to the inventive process is led not directly into the turbines, but into a water stream, which is driving water turbines instead of steam turbines.

The energy of the vapour injected into the water stream is transferred upon the water stream and works as to pressure and as to velocity upon the water molecules and through the same immediately upon the turbine shovels. This energy-transfer occurs practically without losses, if during the mutual enaction of vapour and water no appreciable vapour-condensation occurs. The reaction-time must therefore be that short, that the heat-exchange is being avoided extensively. This may be accomplished by an adequately high water stream velocity and a short reaction distance. For example, there results at the water velocity 400 m/sec and reaction distance of 5 m the reaction-time only of 0.0125 sec, which time does not suffice for any appreciable vapour-condensation. Additionally, it can be shown, that even at a very high impact velocity for the vapour, i.e. at a high relative velocity of the vapour as regards the water stream, for example, c.a. 500 m/sec there results practically still no supersonic impact-heating for the water.

These findings enable the application of high pressure vapour in electrical power plants according to the invented process, contrary to the prejudice respectively of the technical world.

Preferably high output rotary pumps are being used to generate the water stream, while Pelton turbines preferably may be considered representing the turbines, as driven by the stream of water. The water stream may form a closed circuit. The possibility may also exist to use the water coming from the turbines in other ways, for example, for distant heating purposes. The high pressure steam may be obtained from waste heat of boilers or from gas-supercharged steam generators.

The drawing shows schematically an example of an electrical power plant according to the invented process.

Water is taken through a sucking device 2 from a water reservoir 1 by means of a high output rotary pump 3, and is led, at a very high velocity, via a short cyclindrical conduit 4 into the hydraulic turbine 5 of a turbogenerator, from which the water is recycled to the water reservoir 1, with run-off at 6.

Into the water stream high pressure vapour is injected in like direction, which is drawn from a steam generator 7 and is led into the conduit 4 by means of a steam conduit 8, which includes a regulating valve 9. Being expansive, the injected high pressure vapour will, in the presence of a constant magnetic field resistance, accelerate the water's speed of passage through the turbine 5 and thus effect rotation acceleration of the turbogenerator. The resulting increased power output of the generator will be greater than the power output required to generate the water stream, which means an increase in the overall efficiency of the plant.

For example, the following operating data are assumed:

| | |
|---|---|
| water flow (constant) | 100 to/sec. |
| water velocity | 400 m/sec. |
| water pressure | 40 bar. |
| vapour stream velocity | 875 m/sec. |
| vapour pressure | 40 bar. |

Out of these figures according to the known efficiency factors regarding the singular plant units involved, there result the following power data:

| | |
|---|---|
| pumping power intake | 436 Mw. |
| steam power output | 260 Mw. |
| generator power output | 532 Mw. |

The overall efficiency factor is given by the proportion of generator-power output minus pumping-power intake to the steam power applied, which in the case preceding totals 0.37. This is thereby already somewhat better than the efficiency factor 0.30 for most of the large scale electrical power plants in operation.

Another example shows, how with changed conditions, the overall efficiency factor of the plant may yet be higher. In the case, that by applying vapour not the increase in velocity, but the increase in pressure is intended, the following operating data may be assumed:

| | |
|---|---|
| water flow (constant) | 100 to/sec. |
| water velocity | 850 m/sec. |
| water pressure | 20 bar. |
| vapour stream velocity | 1325 m/sec. |
| vapour pressure | 180 bar. |

In this case there results:

| | |
|---|---|
| pumping power intake | 463 Mw. |
| steam power applied | 958 Mw. |
| generator power output | 1066 Mw. |

Therefrom the overall efficiency factor is 0.63.

If energy affects water molecules simultaneously, as to pressure and velocity, this represents an energy-and impulse transfer. Such an energy-and impulse transfer inherits a.o. the physical concept of energy-and impulse—equalization. This again encompasses the physical process of the full-elastic-collision, or conversely so, during the short mutual reaction-time for the steam and for the water (the components of mass are mutually not compressible). Within the context here of the full elastic collision occurring the nonbernoullic pressure-and velocity characteristics of the high pressure steam, at here supersonic velocities, are being transferred upon the water within a short space of time. The possibility of choosing in utilization the mutual reaction of the vapour and the water as to a desired velocity-increase a/o a pressure-increase for the water remains here wholly the function of an adequately chosen a/o set magnetic-field resistance of the turbogenerator, and therefore are automatically included within the context of this invented process, according to the manner of application, and therefore do not stand in contradiction to the affirmative statement of functional proposition.

Steam turbines possess steam condensation, steam expansion, and evidently also supersonic-heating-losses. Such losses appear only minimally within the invented process, i.e., the functional energy-loss for the injected high pressure vapour practically equals the energy-gain of the water stream.

This substantiates the advantage of the invented process as regards the overall efficiency-factor.

I claim:

1. An improvement in a process for generating electrical current by means of hydraulic turbogenerators, wherein a water stream is used to supply motive power to the turbines and wherein high pressure vapor is injected into the water stream, said improvement comprising the steps of:

injecting the high pressure vapor at a point outside of the turbine spaces;

injecting the high pressure vapor through conduits with relatively small interior cross-sectional areas; and injecting the high pressure vapor into a water stream having a very high flow rate, such that continuous pressure and velocity increases are caused in the water stream by the injected vapor and practically no heat exchange takes place between the injected vapor and the water prior to contact with the turbines.

2. The improvement as claimed in claim 1, further comprising the step of using high output rotary pumps for generating the water stream.

3. The improvement as claimed in claim 1, further comprising the step of generating the high pressure vapor in steam generators.

4. The improvement as claimed in claim 1, further comprising the step of recirculating the water discharged from the turbines, such that the water is circulated in a closed circuit.

5. The improvement as claimed in claim 1, wherein the water stream has a velocity on the order of 400 meters per second and said high pressure vapor is injected at a point on the order of 5 meters upstream the turbines.

* * * * *